United States Patent [19]

Dziak

[11] Patent Number: 4,489,986

[45] Date of Patent: Dec. 25, 1984

[54] WEAR COLLAR DEVICE FOR ROTATABLE CUTTER BIT

[76] Inventor: William A. Dziak, 15100 Tokay Ave., Maple Heights, Ohio 44137

[21] Appl. No.: 438,018

[22] Filed: Nov. 1, 1982

[51] Int. Cl.[3] ..... E21C 35/22

[52] U.S. Cl. ..... 299/86; 299/92

[58] Field of Search ..... 299/86, 91–93; 175/354, 413; 37/142 R, 142 A; 407/7

[56] References Cited

U.S. PATENT DOCUMENTS 3,841,708 10/1974 Kniff et al. ..... 299/92 X
4,084,856 4/1978 Emmerich et al. ..... 299/86
4,201,421 5/1980 Den Besten et al. ..... 299/86
4,333,687 6/1982 Barnstorf ..... 299/86 X

*Primary Examiner*—James A. Leppink
*Assistant Examiner*—Thuy M. Bui
*Attorney, Agent, or Firm*—Watts, Hoffmann, Fisher & Heinke Co.

[57] ABSTRACT

A mounting system for rotatably supporting a cutter bit which includes a mounting block for rotatably supporting a cutter bit and having a detachable and replaceable wear collar member for supporting the bit within the block which acts to prevent wear between the bit and the block.

5 Claims, 2 Drawing Figures

WEAR COLLAR DEVICE FOR ROTATABLE CUTTER BIT

TECHNICAL FIELD

The present invention relates to cutter bits and more particularly relates to cutter bits of the type used in excavation applications such as in trenching, road scarifying or the like. The present invention is especially concerned with a new and improved construction of a mounting block for rotatably supporting a cutter bit by means of a detachable and replaceable wear collar member which operates to support the bit in the block. The general purpose of such wear collar member being to reduce the wear on the bit and block, and especially the block since it is relatively expensive to replace, as compared to the bit. In addition, such wear collar member adds a support and stabilizing factor to the bit to afford uniform rotational movement to the bit and hence, to promote uniform wear on the working bit surfaces.

BACKGROUND ART

The present invention relates to a mounting block assembly which incorporates a detachable and replaceable wear collar member for rotatably supporting a cutter bit within such block. Heretofore, such cutter bits have included the type generally known as conical bits or pik-bits of the type used for construction and excavation applications. For example, such cutter bits are generally utilized with such mounting blocks which are detachable or fixably mounted on an excavating wheel of a trenching machine or on the drive wheel of a road scarifying machine or the like. Such cutter bits are illustrated, for example in U.S. Pat. Nos. 3,841,708 and 4,201,421.

Heretofore, there has been a need to mount such cutter bits in a rotatable relationship relative to the blocks so as to minimize wear between the component parts while permitting easy assembly and replacement of the parts when necessary. It is especially important to minimize the wear on the mounting blocks themselves as their cost for replacement is relatively high compared to the replacement cost of the bits. It will be recognized, however, that it is also important to minimize, to the greatest extent possible, wear on the bits since a relatively substantial number of bits are required for each such excavating machine and oftentimes a full set of bits (i.e. 500 or more) are replaced after merely a few hours of operation due to damage and/or wear. In addition, it is important to support and stabilize the bit to the greatest extent possible so as to promote the generally concentric uniform rotational movement of the bit relative to the block thereby to promote uniform wear on the bit. In this case, it will be recognized that such uniform wear increases the overall wear-life of the bit.

DISCLOSURE OF THE INVENTION

The present invention relates to a mounting block assembly of the type for rotatably mounting a cutter bit which includes a detachable and replaceable wear collar member for supporting the bit within the block. In the invention, the wear collar is detachably mounted on the mounting block by means of a resilient ring member which may be made from an elastomeric or polymeric material for snap-action retaining engagement within a correspondingly shaped groove provided in the mounting block. By this arrangement, the wear collar can be quickly and easily removed from the mounting block and at the same time provides a wear-like seat for the cutting bit which includes a cam-like shoulder for mounting engagement within a correspondingly shaped seating surface provided in the wear collar member. In the invention, the cutter bit may be mounted for substantially free-rotation within the block by means of a suitable retainer of the type illustrated, for example, in U.S. Pat. No. 3,841,708.

SUMMARY OF THE INVENTION

A mounting system of the type for mounting a cutter bit for substantially free-rotation about a longitudinal axis in a mounting block. A wear collar member is disposed for detachable mounting connection on the mounting block and defines a cam-like seat for rotatably mounting the cutter bit therein. The wear collar member is detachably mounted on the mounting block via a resilient ring member which may be made from an elastomeric or polymeric material disposed to provide a snap-action interlocking connection between the mounting block and the wear collar member. The cutter bit is mounted for substantially free-rotation within the mounting block by means of a retainer element of the type to prevent axial displacement of the cutter bit within the mounting block member while enabling the substantially free-rotation thereof.

DESCRIPTION OF THE PREFERRED EMBODIMENTS

Figure 1:
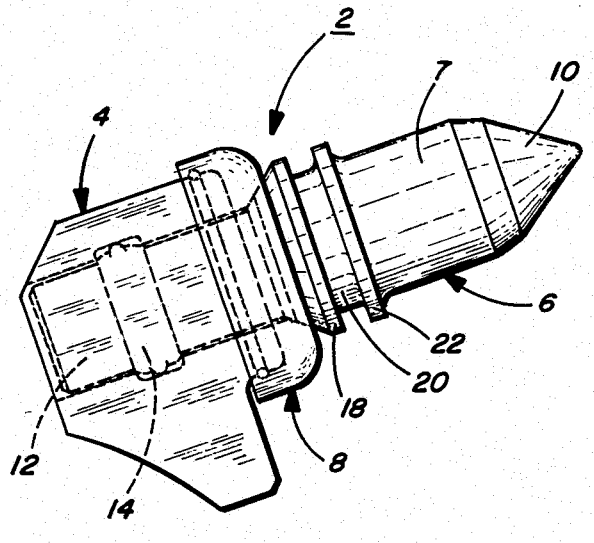
FIG. 1 is a generally side elevation view of the mounting system of the present invention illustrating a cutter bit mounted for substantially free-rotation within a mounting block, and with the wear collar member detachably mounted on the block and supporting the cutter bit in the installed position thereof.
Figure 2:
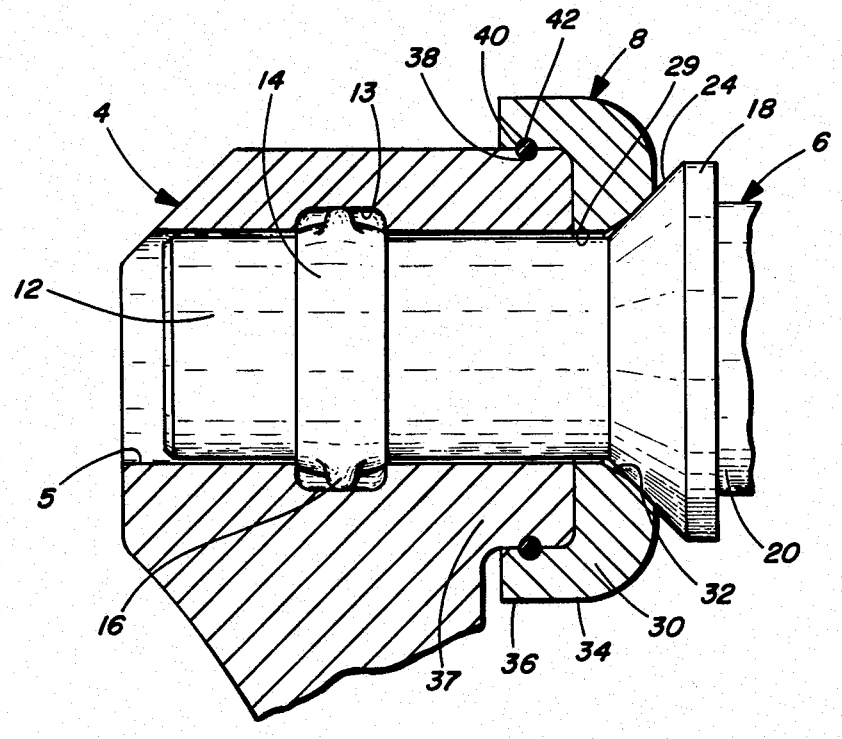
FIG. 2 is a fragmentary, vertical section view, on an enlarged scale, representing in more detail the features of the invention illustrated in FIG. 1 thereof.

Referring again to the drawings and in particular to FIG. 1 thereof, there is illustrated the mounting assembly, designated generally at 2, of the present invention. As generally illustrated, the assembly includes a mounting block member 4 which has an internal bore, as at 5, for mounting in a substantially free-rotational relationship a cutter bit 6. The cutter bit is generally of a conventional construction recognized in the field as a pik-type bit which has a cylindrical body portion 7 which merges into a conical carbide tip portion 10. The rearward portion of the cutter bit includes a cylindrical shank 12 which is mounted for substantially free-rotation within the bore 5 by means of a resilient retainer element, as at 14, which has a plurality of dimples, as at 16, for co-acting engagement within a groove, as at 13, provided in the block member for retaining the cutter bit against axial movement as known in the art and as generally described in U.S. Pat. No. 3,841,708. As shown, the bit element 6 has a pair of parallel, laterally spaced shoulder members 18 and 22 separated by a groove 20 with the shoulder portion 18 having an inclined tapered surface 24 which provides a cam-like seat 24 of a generally conical configuration.

Now in the invention, the wear collar member 8 is of a cylindrical configuration having a cylindrical inlet opening 29 which opens onto an inclined tapered surface 32 which provides a cam-like seat surface for the confronting tapered conical surface 24 of the shoulder portion 18 on the cutter bit 6. By this arrangement, the wear collar member provides a cam-like seat so as to give a surface-to-surface friction contact between the wear collar member and the confronting conical surface of the shoulder portion 18 of the cutter bit to stabilize and hence, to afford a more uniform wear between the component parts. As to the collar member itself, it includes a body 30 having a curved or radius surface, as at 34, which merges into an integral annual flange 36 which has a transverse dimension to slidably fit over and around the confronting circular end portion, as at 37, of the mounting block member 4.

In the invention, the collar member 8 is detachably mounted on the cylindrical portion 37 of the mounting block member 4 by means of a resilient ring element, as at 42. The ring element 42 is preferably made from an elastomeric or polymeric material having high strength yet good flexibility characteristics. For example, an elastomeric material would include a neoprene rubber while a polymeric material would include nylon, Teflon or the like. As illustrated, the resilient element 42 is disposed within a semicircular groove, as at 38, provided in the mounting block member and in a corresponding semi-circular groove, as at 40, provided in the integral flange portion 36 of the wear collar member 8. By this arrangement, the resilient member 42 provides an effective snap-action interconnection between the wear collar member 8 and the mounting block member 4.

Accordingly, by this arrangement the cutter bit 6 can be quickly and easily inserted for substantially free-rotation within the mounting block via the retainer element 14. In this installed position, the wear collar member 8 provides an effective bearing and wear surface for supporting the cutter bit 6 whereby after repeated usage the wear collar member can be simply replaced for repeated usage, as desired. By this arrangement, there is provided a relatively simple and inexpensive yet reliable wear collar member which can be readily replaced so as to afford prolonged usage of the more expensive component parts, namely, the mounting block and its corresponding cutter bit.

Other advantages and objects of the present invention will become more apparent when considered in conjunction with the appended claims.

I claim:

1. A mounting system of the type for detachably supporting a cutter bit for excavating operations or the like comprising, a mounting block member having an axial bore extending therein, a wear collar member disposed for detachably mounting on said block member, a flexible retainer ring element disposed for snap-action co-acting engagement between said block member and said wear collar member for retaining the latter in generally stationary relationship relative to said block member, said wear collar member having an opening disposed in generally concentric relation relative to the bore in said block member and said opening being defined by an inwardly tapered peripheral surface defining a seat portion adapted for confronting surface-to-surface engagement with a generally complimentary shaped shoulder portion provided on said cutter bit to enable rotation of said cutter bit relative to said block member when disposed in said bore, and retainer means operably associated with said block member and said cutter bit to enable substantially free-rotation of said cutter bit within said bore and to prevent axial displacement of said cutter bit from within said bore, and wherein said collar member is of a generally circular configuration having an integral radial flange extending outwardly in a direction away from said tapered seat portion, and said flange being provided with annular groove means adapted to receive said flexible retainer ring element.

2. A mounting system in accordance with claim 1, wherein said block member has an integral cylindrical portion, said collar member being of a circular configuration having a circular opening disposed in generally concentric relation relative to the bore in said block member, annular groove means disposed in said cylindrical portion and said wear collar member, and said flexible retainer ring element being disposed in said groove means in the installed position of said wear collar member on said block member.

3. A mounting system in accordance with claim 1, wherein said flexible retainer ring element is made from an elastomeric or polymeric material.

4. A mounting system in accordance with claim 1, wherein said block member has an integral cylindrical portion, the bore in said block member extending into said hub portion and being generally centrally aligned with the opening in said wear collar member, said cylindrical portion having an exterior annular groove means adapted for registration with the groove means provided on the flange portion of said wear collar member and adapted to receive said flexible retainer ring element in snap action co-acting engagement therebetween in the installed position of said wear collar member on the hub portion of said block member.

5. A mounting system in accordance with claim 1, wherein said cutter bit includes a conical head portion and an elongated cylindrical shank portion, an integral radial shoulder portion disposed between said head and shank portions and defining an annular tapered cam surface portion adapted for surface-to-surface sliding engagement with the confronting surface on the said wear collar member, and said retainer means including a resilient annular spring-clip carried by said shank portion and disposed for interlocking coacting engagement with said block member interiorly of said bore to prevent axial displacement of said cutter bit from within said bore while enabling substantially free-rotation of said cutter bit within said bore.

* * * * *